United States Patent [19]

Miller, Jr.

[11] Patent Number: 5,059,130

[45] Date of Patent: Oct. 22, 1991

[54] MINIMAL SPACE PRINTED CICUIT BOARD AND ELECTRICAL CONNECTOR SYSTEM

[75] Inventor: Grady A. Miller, Jr., Grand Prairie, Tex.

[73] Assignee: LTV Aerospace and Defense Company, Grand Prairie, Tex.

[21] Appl. No.: 522,258

[22] Filed: May 11, 1990

Related U.S. Application Data

[63] Continuation of Ser. No. 210,751, Mar. 23, 1988, Pat. No. 4,950,170.

[51] Int. Cl.[5] ..... H01R 9/09

[52] U.S. Cl. ..... 439/74; 439/82

[58] Field of Search ..... 439/65, 74, 75, 81, 439/82, 825

[56] References Cited

U.S. PATENT DOCUMENTS

| | | | |
|---|---|---|---|
| 2,913,634 | 11/1959 | Scoville | 317/101 |
| 2,977,562 | 3/1961 | Benson | 339/17 |
| 3,270,251 | 8/1966 | Evans | 317/101 |
| 3,526,867 | 9/1970 | Keeler, II | 339/17 |
| 3,569,607 | 3/1971 | Martyak et al. | 174/685 |
| 3,591,922 | 7/1971 | Pardee et al. | 29/626 |
| 3,904,934 | 9/1975 | Martin | 317/101 |
| 4,133,592 | 1/1979 | Cobaugh et al. | 339/17 |
| 4,232,924 | 11/1980 | Kline et al. | 339/17 |
| 4,420,877 | 12/1983 | McKenzie, Jr. | 29/739 |
| 4,533,200 | 8/1985 | Wilson | 439/74 |
| 4,641,426 | 2/1987 | Hartman et al. | 29/839 |
| 4,663,815 | 5/1987 | Hartman et al. | 29/839 |
| 4,664,458 | 5/1987 | Worth | 439/74 |
| 4,797,113 | 1/1989 | Lambert | 439/74 |
| 4,909,740 | 3/1990 | Scholz | 439/74 |
| 4,950,170 | 8/1990 | Miller Jr. | 439/74 |

FOREIGN PATENT DOCUMENTS

| | | | |
|---|---|---|---|
| 2756149 | 6/1979 | Fed. Rep. of Germany | 439/74 |

*Primary Examiner*—Paula A. Bradley

*Attorney, Agent, or Firm*—Arnold, White & Durkee

[57] ABSTRACT

A system of printed circuit boards is interconnected by using connectors having electrically conductive assemblies that include both pins and sockets. The pins of the assemblies of one connector pass through apertures in the printed circuit boards and engage the sockets of assemblies of another connector on the other side of the printed circuit board. In this manner any number of printed circuit boards may be interconnected to form continuous electrical circuits from one printed circuit board to the next and also provide a mechanical means of holding the system of printed circuit boards together.

9 Claims, 3 Drawing Sheets

MINIMAL SPACE PRINTED CICUIT BOARD AND ELECTRICAL CONNECTOR SYSTEM

This is a continuation of co-pending application Ser. No. 07/210,751 filed on June 23, 1988 now U.S. Pat. No. 4,950,170.

BACKGROUND AND SUMMARY OF THE INVENTION

The present invention relates broadly to electrical circuit boards, and more particularly to a system for interconnecting such boards. The invention more especially relates to a system wherein the pins in one connector on one side of a circuit board extend through electrically conductive apertures in the circuit board to a socket in a connector on the other side of the circuit board. The resulting assembly of circuit boards and connectors may resemble a "sandwich".

A common problem in interconnecting printed circuit boards is the space required for making the necessary connections. The problem is particularly acute in applications such as guided missiles where equipment must generally be as compact as possible. Unfortunately, the connectors currently used in such applications occupy considerable space between the circuit boards they serve to interconnect. More efficient use of the space in equipment using circuit boards results in smaller equipment which is often critical in applications such as guided missiles. Consequently, the art has sought to reduce the amount of wasted space. It is accordingly a general feature of the present invention to provide a system of interconnecting circuit boards which reduces the space presently required between circuit boards.

The use of pins on connectors which pass through apertures on printed circuit boards is known. For example, U.S. Pat. No. 4,133,592 teaches the use of such connectors to increase the efficiency of connections between printed circuit boards.

Although the use of such connectors is known, there has been no suggestion for using such connectors both to provide the mechanical force necessary to hold the system together and also to provide connections for power and ground circuits. Further, there has been no suggestions for using a split-tip pin which provides a better electrical contact based on 1) the mechanical force it exerts to maintain contact, and 2) its greater surface area of contact.

The invention reduces the wasted space in parallel arrays of printed circuit boards by decreasing the space required for interconnecting the circuit boards. Further, it provides for electrical signal, power, and ground connections between the parallel circuit boards and also provides a mechanical connection using a connector device which is separate from the circuit boards.

The present invention in a broad aspect comprises a system of interconnected printed circuit boards wherein multiple bi-polar assemblies are employed to interconnect two connectors on opposite sides of a printed circuit board with each other and also with the circuit board. In its simplest form an individual assembly comprises an elongated electrical conductor which has a pin at one end and a socket at the other. The assembly is mounted or embedded in a suitable connector board or the like such that the mouth of the socket is generally flush with one surface or side of the connector board, and such that the pin extends beyond the opposite side or surface of the connector board a distance sufficient to pass through an aperture in a circuit board and enter the socket end of a similar assembly in a second connector board. The aperture in the circuit board is, itself, electrically conducting and serves to connect the pin electrically with circuits or the like on the circuit board. At either end of such a system a flexible ribbon conductor with the appropriate pins or sockets connects to the connector for electric signal transmission.

The foregoing assembly is generally preferred for use in transmitting signals between circuit boards and connectors. A modified form of that assembly is preferably employed to make both a mechanical connection and also an electrical connection for transmitting electrical power. The modified form is basically larger and sturdier than the signal form, and includes a split-tip pin.

BRIEF DESCRIPTION OF DRAWINGS

The above-noted and other aspects of the present invention will become more apparent from a description of the preferred embodiment when read in conjunction with the accompanying drawings.

The drawings illustrate the preferred embodiment of the invention, wherein like members bear like reference numerals and wherein.

DESCRIPTION OF THE PREFERRED EMBODIMENT

Figure 1:
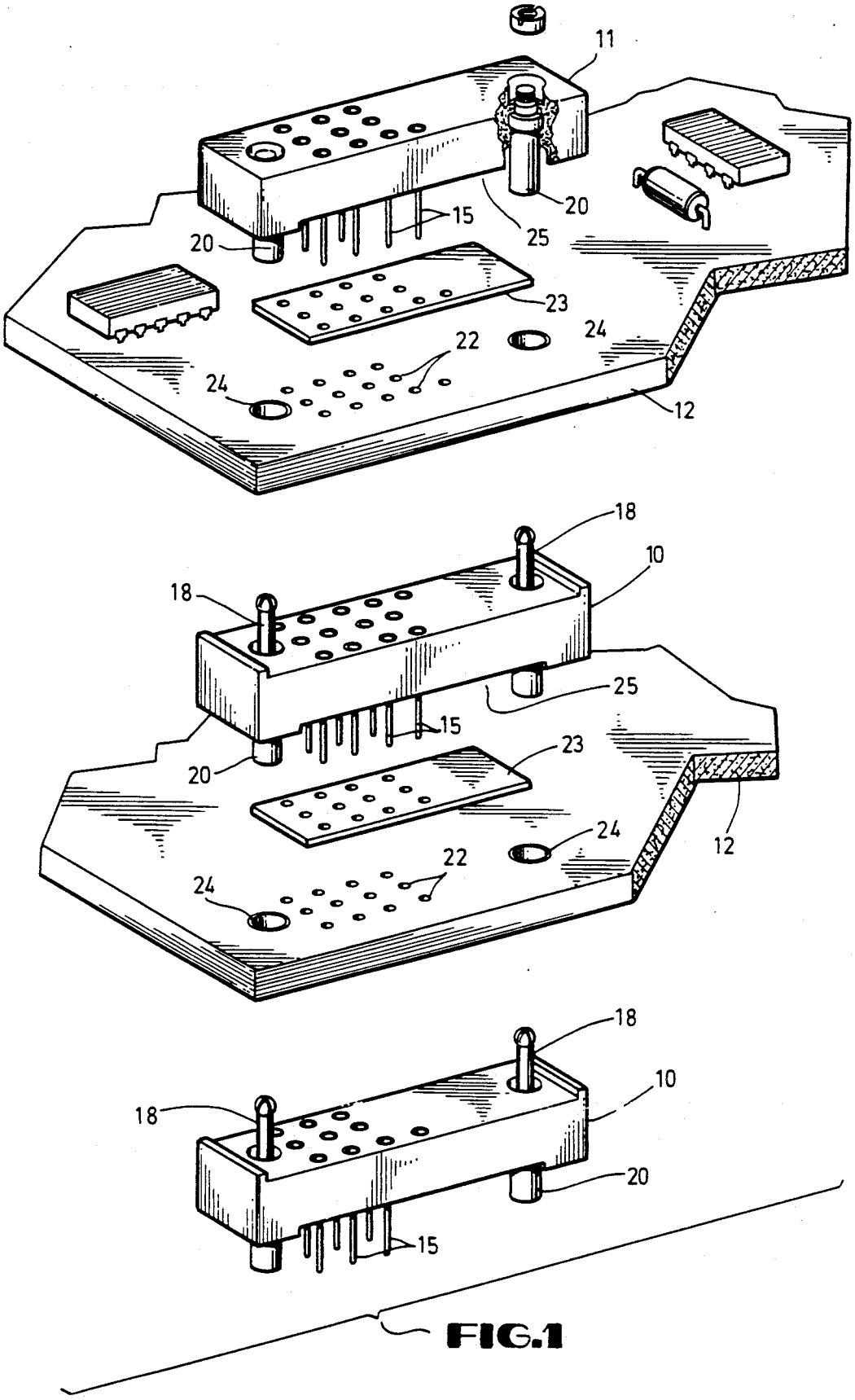
FIG. 1 illustrates an exploded view of a system of printed circuit boards and connectors.

FIG. 1 illustrates connectors 10 built according to the present invention and printed circuit boards 12 in which the connectors plug. Multiple boards 12 connected together comprise a circuit board system. An end connector 11 is used at one end of the system.

Figure 2:
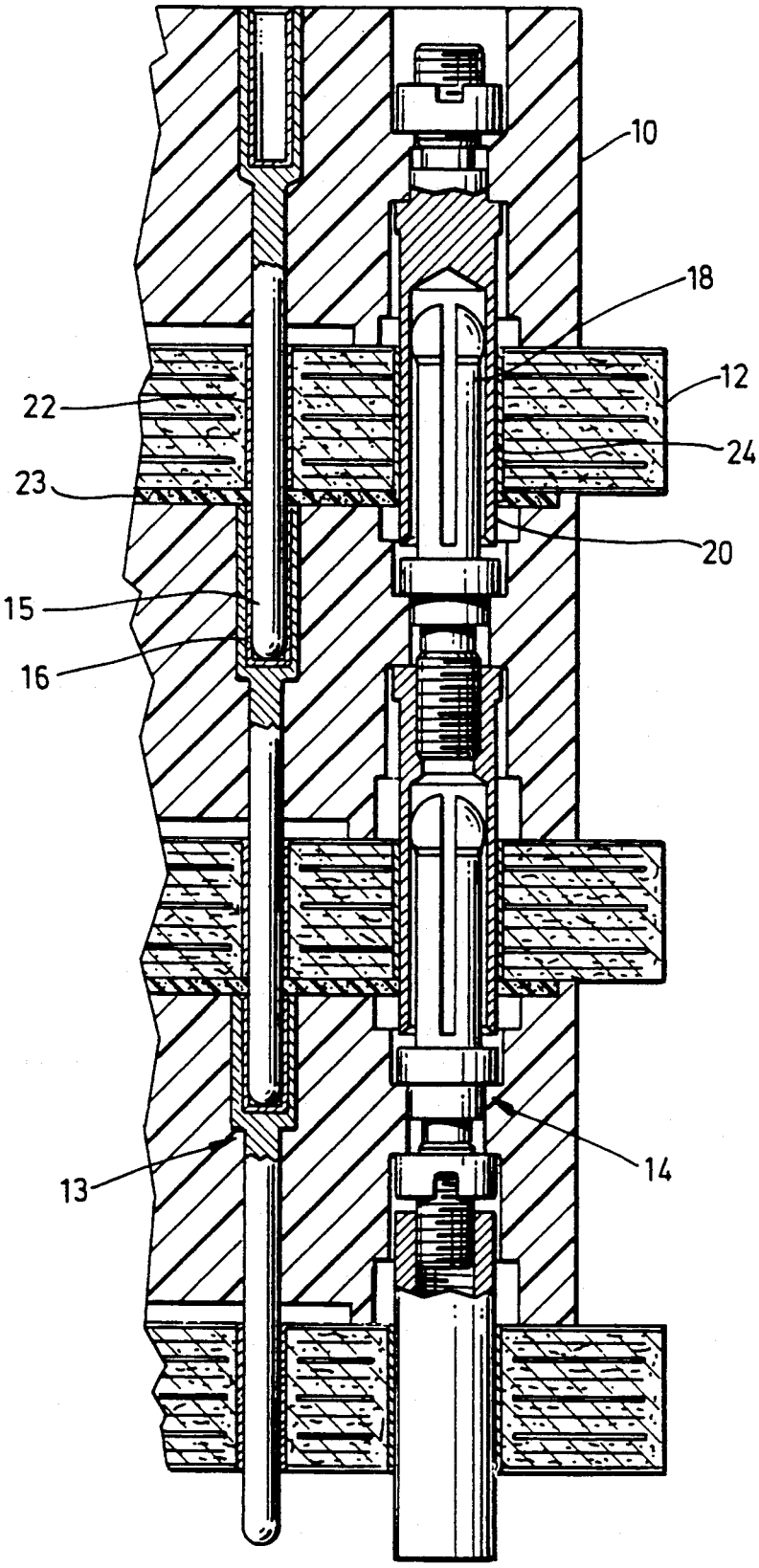
FIG. 2 illustrates a detailed view of signal and power assemblies.

Referring to FIG. 2, each connector 10 includes multiple signal assemblies 13 and multiple power assemblies 14. Each signal assembly 13 has a signal pin 15 and a signal socket 16 for carrying electrical signals. Each power assembly 14 has a power pin 18 and a power socket 20 for providing both a mechanical connection and for electrical power and ground. Each connector 10 is made of a dielectric material except that the outer surface is plated with an electrically conductive material.

Referring to both FIG. 1 and FIG. 2, each printed circuit board 12 has signal apertures 22 extending through the board which receive the signal assemblies 13, and power apertures 24 extending through the board which receive the power assemblies 14. The apertures 22 and 24 need not have circular cross-sections. Rather, square, hexagonal, or other cross-sections may be used. The apertures 22 and 24 in one board !2 align with the apertures 22 and 24 respectively in another board 12. A closed cell silicone environmental gasket 23 separates the pin side 25 of the connector from the printed circuit board, to keep moisture out of the apertures 22 and 24.

Each signal pin 15 of a first signal assembly 13 extends through its respective circuit board aperture 22 into the socket 16 of a second signal assembly 13 in the connector 10 on the opposite side of the circuit board 12. Each signal socket 16 is flush with the edge of the connector 10. The signal assembly 13 provides a continuous electrical path from one connector to another connector. Signals from the signal pins 14 travel to the printed circuit boards through the apertures 22 which are plated with electrically conductive material, and communicate with the appropriate signal circuits on the printed circuit board.

Each signal pin 15 has a circular cross-section with a rounded tip and is made of an electrically conductive material. The outside diameter of the signal pin 15 is substantially the same as the inside diameter of the signal sockets 16 which receive the signal pins 15, and is also substantially the same as the inside diameter of the apertures 22. Only a small amount of mechanical force is required to insert the signal pins 15 through the circuit board apertures 22 into the socket 16 in the connector 10 on the other side of the circuit board.

The power pin 18 of a first power assembly through its corresponding circuit board aperture 24 into the socket 20 of a second power assembly 17 in the connector 10 on the other side of the circuit board.

Figure 3:
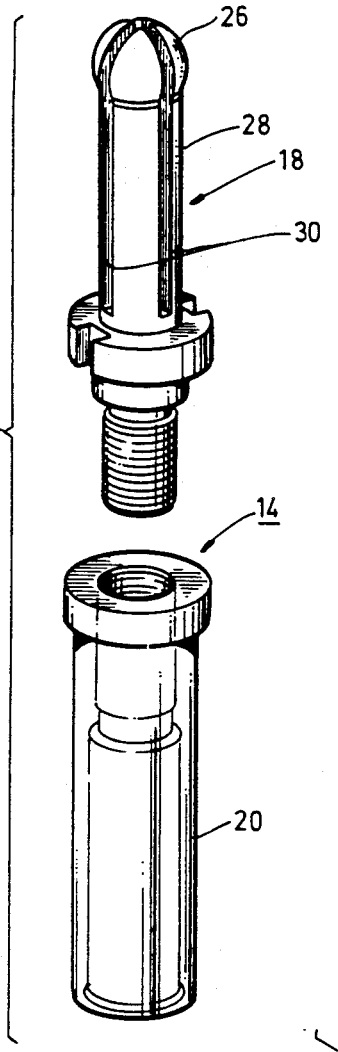
FIG. 3 illustrates a power assembly.

FIG. 3 illustrates a perspective view of the power pin 18, having a tip 26 and a shaft 28. The tip 26 is a hemisphere of slightly larger diameter than the shaft 28. The tip 26 and the shaft 28 are split into four parts of substantially equal size by two slots 30 at 90~ angles to each other. The pin is made of an electrically conductive material such as heat-treated BeCu Alloy 123 with a nickel-plated finish.

The tip 26 without radial compression has a slightly larger diameter than the socket 20. The two slots 30 in the power pin 18 allow the pin 18 of a first power assembly 17 to be radially compressed in the socket 20 of a second power assembly. The compression of the power pin 18 provides the mechanical force to keep the pin 18 in tight contact with the socket 20 in spite of vibration or other mechanical shocks to the system. The power assembly 17 provides a continuous electrical path from one connector to another connector. The power and ground circuits of the printed circuit boards are communicated to the power pins 18 through the apertures 24 which are plated with electrically conductive material and communicate with the appropriate power and ground circuits on the printed circuit board.

Figure 4:
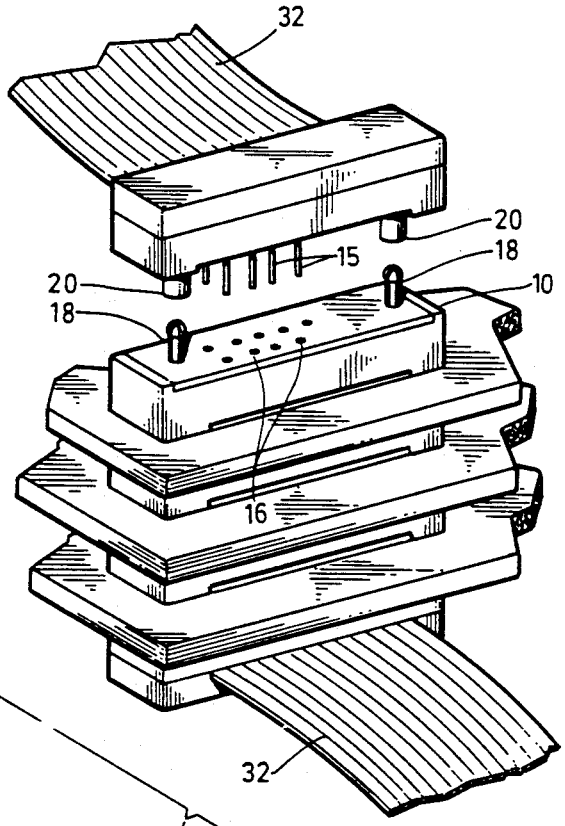
FIG. 4 illustrates a flexible ribbon conductor attached to a connector.

Referring now to FIG. 4, a connector 10 is depicted connected to a flexible ribbon conductor 32. The flexible ribbon conductor 32 connects to the connector 10 at either end of a system of circuit boards. The signal pins 14 fit into sockets in the flexible ribbon conductor 32 sized to match the signal pins 14. Likewise, the socket 20 receives a pin from the flexible ribbon conductor and the power pin 18 fits into a socket in the flexible ribbon conductor. Although not shown, a flexible ribbon conductor 32 has signal pins 14 which fit into the signal sockets 16 of a connector 10.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. A connector for interconnecting printed circuit boards, said printed circuit boards comprising multiple through apertures and electrical conductors associated therewith wherein the electrical conductors are plated to the boards and extend within the apertures, said connector comprising:

a unitary conductor body having top and bottom surfaces each configured to fit against a corresponding surface of the printed circuit boards to be interconnected thereby, and at least one electrical connecting element mounted within said connector body and including a pin-type connecting section at one end thereof, and a socket-type connecting section at the other end thereof, said socket-type section being adapted to receive therein a pin-type connecting section for establishing a sliding electrical contact therebetween, said pin-type connecting section of said electrical connecting element having a solid cross-section and projecting outwardly from said connector body for a distance sufficient for said pin-type section to project through the apertures in a printed circuit board into a socket-type connecting section of a corresponding connecting element of another such connector thereby establishing a sliding electrical and mechanical connection between the pin-type connecting section of said connector, said circuit board, and said socket-type connecting section of said other connector.

2. The connector according to claim 1 wherein said pin-type connecting section has a substantially cylindrical cross-section.

3. The connector according to claim 1 wherein the pin-type connecting section of at least one of said electrical connecting elements comprises a tip divided into two or more sections, said tip having a nominal outside diameter greater than the inside diameter of the corresponding socket-type connecting section of said electrical connecting element.

4. The connector according to claim 3 wherein said sectional tip of said pin-type connecting section has a substantially cylindrical cross-section.

5. In combination, at least one printed circuit board interconnected with another printed circuit board or a source of signals such as a ribbon connector, by a circuit board connector, said printed circuit board comprising multiple through apertures and electrical conductors are plated to the boards and extend within the apertures, said circuit board connector comprising:

a connector body having opposed surfaces configured to fit against a corresponding surface of said circuit board, and a plurality of electrical connecting elements mounted within said connector body and including a pin-type connecting section at one end thereof and a socket-type connecting section at the other end thereof, said socket-type section being adapted to receive therein a pin-type connecting section from a first other circuit board connector for establishing a sliding electrical contact therebetween, said pin-type connecting section of each of said connecting elements comprising a solid cross-section projecting outwardly from said connector body and through the apertures in said circuit board for a distance sufficient to project into a socket-type connecting section of a second other circuit board connector thereby establishing sliding electrical contact between the plurality of connecting elements of said connector, said circuit board, and said second other connector, wherein said plurality of connecting elements comprises a first group of elements adapted to provide electrical contact between said connector and said circuit board, and a second group of elements adapted to provide both electrical and mechanical connection between said connector and said circuit board.

6. The combination of claim 5 wherein said first and second group of connecting elements have pin-type connecting sections with a substantially cylindrical cross-section.

7. The combination of claim 6 wherein the pin-type connecting sections of said second group of elements have tips divided into two or more sections, said tips having a nominal outside diameter greater than the inside diameter of the corresponding socket-type connecting sections of said connecting elements.

8. A printed circuit board system comprising:

a. first and second spaced printed circuit boards, each board having multiple through apertures and electrical conductors associated therewith wherein the associated electrical conductors are plated to the boards, and extend within the apertures; and b. first and second connectors each including a plurality of electrically conductive assemblies associated therewith for electrically and mechanically connecting the first board to the second board, each electrically conductive assembly comprising:

i. a socket at a first end, the socket having an inner surface and an outer surface; and ii. a pin at a second end, said pin including means for fixedly engaging the inner surface of a socket;

wherein the outer surface of the socket of a first electrically conductive assembly associated with the first connector is fittably and removably engaged with an aperture of the first printed circuit board thereby making electrical contact with the associated electrical conductor, the pin of a second electrically conductive assembly associated with the second connector fixedly engages the inner surface of the socket of the first electrically conductive assembly, and wherein the outer surface of a socket of the second electrically conductive assembly is fittably and removably engaged with an aperture of the second printed circuit board thereby making electrical contact with the associated electrical conductor, whereby the first and second printed circuit boards are mechanically and electrically connected.

9. The printed circuit board system of claim 8 wherein the means for fixedly engaging the inner surface of a socket include a pin tip divided into two or more sections, said tip having a nominal outside diameter greater than the inside diameter of the socket.

* * * * *